United States Patent [19]

Krohn et al.

[11] 4,009,971

[45] Mar. 1, 1977

[54] ELECTRIC MOTOR-DRIVEN, DOUBLE-ACTING PUMP HAVING PRESSURE-RESPONSIVE ACTUATION

[75] Inventors: Duane D. Krohn; Samuel W. Culbertson, both of Arvada, Colo.

[73] Assignee: Binks Manufacturing Company, Franklin Park, Ill.

[22] Filed: Aug. 27, 1974

[21] Appl. No.: 500,948

Related U.S. Application Data

[63] Continuation-in-part of Ser. No. 477,216, June 7, 1974, abandoned, which is a continuation of Ser. No. 415,865, Nov. 13, 1973, abandoned, which is a continuation of Ser. No. 184,359, Sept. 28, 1971, abandoned, which is a continuation-in-part of Ser. No. 150,445, June 7, 1971, abandoned.

[52] U.S. Cl. ..... 417/43; 417/44; 417/223; 417/415

[51] Int. Cl.[2] ..... F04B 49/00

[58] Field of Search ..... 417/223, 38, 43, 44, 417/415; 92/168, 60.5; 200/81.4, 83 W

[56] References Cited

UNITED STATES PATENTS

| | | | |
|---|---|---|---|
| 1,116,998 | 11/1914 | Compton | 417/223 |
| 1,128,089 | 2/1915 | Astrom | 417/543 |
| 1,171,270 | 2/1916 | Sorge | 417/44 |
| 1,535,643 | 4/1925 | Astrom | 92/168 X |
| 2,651,995 | 9/1953 | Blackburn | 417/44 X |
| 2,791,100 | 5/1957 | Maurer | 417/319 |
| 2,866,528 | 12/1958 | Jacobs | 417/223 |
| 2,923,790 | 2/1960 | Ernst | 200/81.4 X |
| 2,945,444 | 7/1960 | Leissner | 417/269 |
| 2,975,599 | 3/1961 | Bennett | 92/168 X |
| 3,050,003 | 8/1962 | Edwards | 417/43 |
| 3,502,029 | 3/1970 | Halladay | 417/44 X |
| 3,689,199 | 9/1972 | Bassinger | 92/60.5 X |

*Primary Examiner*—Carlton R. Croyle
*Assistant Examiner*—Thomas I. Ross
*Attorney, Agent, or Firm*—Gary, Juettner

[57] ABSTRACT

A double acting pump is operated by a crank that is powered through a gear train driven by an electric motor. An adjustable pressure sensing device is used to control operation of the pump. A single motor, double pump embodiment is also described.

7 Claims, 10 Drawing Figures

50
54
52
56
38
36
44
58
64
60
62
68
66
46
48
42
32
40

ELECTRIC MOTOR-DRIVEN, DOUBLE-ACTING PUMP HAVING PRESSURE-RESPONSIVE ACTUATION

CROSS REFERENCE

This is a continuation-in-part of copending application, Ser. No. 477,216, filed June 7, 1974, now abandoned, which is a continuation of abandoned application Ser. No. 415,865, filed Nov. 13, 1973, which is a continuation of abandoned application Ser. No. 184,359, filed Sept. 28, 1971, which is a continuation-in-part of abandoned application Ser. No. 150,445, filed June 7, 1971.

BACKGROUND OF THE INVENTION

This invention relates to hydraulic systems and more particularly to an airless pump and an operating mechanism therefor, said pump being particularly useful in conjunction with the airless or hydraulic spraying of paint or other liquid coating materials.

In airless spray painting, the paint is supplied at high pressure in the order of about 1,000 to 3,000 p.s.i. to an atomizing nozzle having a small eliptically shaped orifice therethrough. The paint is atomized hydraulically upon passage through the orifice into a fan-shaped spray as is known in the art. In spray painting, it is conventional to spray intermittently, and a valve is associated with the nozzle to accommodate starting and stopping of the spray as desired or required.

Because of the necessity for intermittent operation, some means must be provided to control the internal pressure within the pump, to prevent excessive build up of pressure when the spray nozzle valve is closed. In order to overcome this problem, it has been proposed to use an air motor to actuate the pump, such motors being operable only when required to meet a pressure requirement in the pump. Air motors, however, have not fulfilled all of the requirements of the art since they require a source of air, which in the case of allegedly portable equipment requires bulky and expensive air compressors and pressure tanks. Many attempts have been made to employ an electric motor to drive high pressure pumps for airless spraying, but with little success.

In addition to preventing excessive pressure build up in an airless pump, it is also desirable to maintain a fairly constant pressure at the spray tip even though the spray gun may be operated intermittently. Otherwise, the paint that is initially emitted from the nozzle is not properly atomized. In order to achieve these and other desiderata of the art, various types of pressure by-pass arrangements have been employed in combination with an electric pump, one of which is shown and described in the Enssle, U.S. Pat. No. 3,433,415. There, a multiple valve arrangement is employed to maintain a constant pressure at the closed nozzle while allowing continuous operation of the pump and electric motor by providing a by-pass around the pump outlet when the nozzle is closed. Such arrangements require the use of many complex parts that are not ideally suited for changing of paint colors and cleaning, as well as service-free use. Moreover, airless pumps with electric motors have heretofore employed drive belts and pulleys between the motor and the pump that are subject to wear.

Summary of the Invention

An object of this invention is to provide the combination of a high pressure pump and an electric motor that does not require a separate by-pass or recirculation system therein to control pressures developed in the pump.

Another object of the invention is the provision of an airless spray pump that develops a pressure which may be easily and conveniently adjusted over a wide range of values.

A further object is the provision of a pump that is operated by an electric motor without intervening chains, belts or pulleys.

A still further object is to provide a pump and operating mechanism therefor which is simple in construction and will maintain a constant pressure regardless of intermittent operation and without fear of excessive pressure build up.

An additional object is the provision of a single power mechanism and drive that is capable of operating two pumps simultaneously.

Other objects will become apparent from the following description and appended claims, taken in connection with the accompanying drawings.

THE DRAWINGS

DESCRIPTION OF THE PREFERRED EMBODIMENTS

Figure 1:
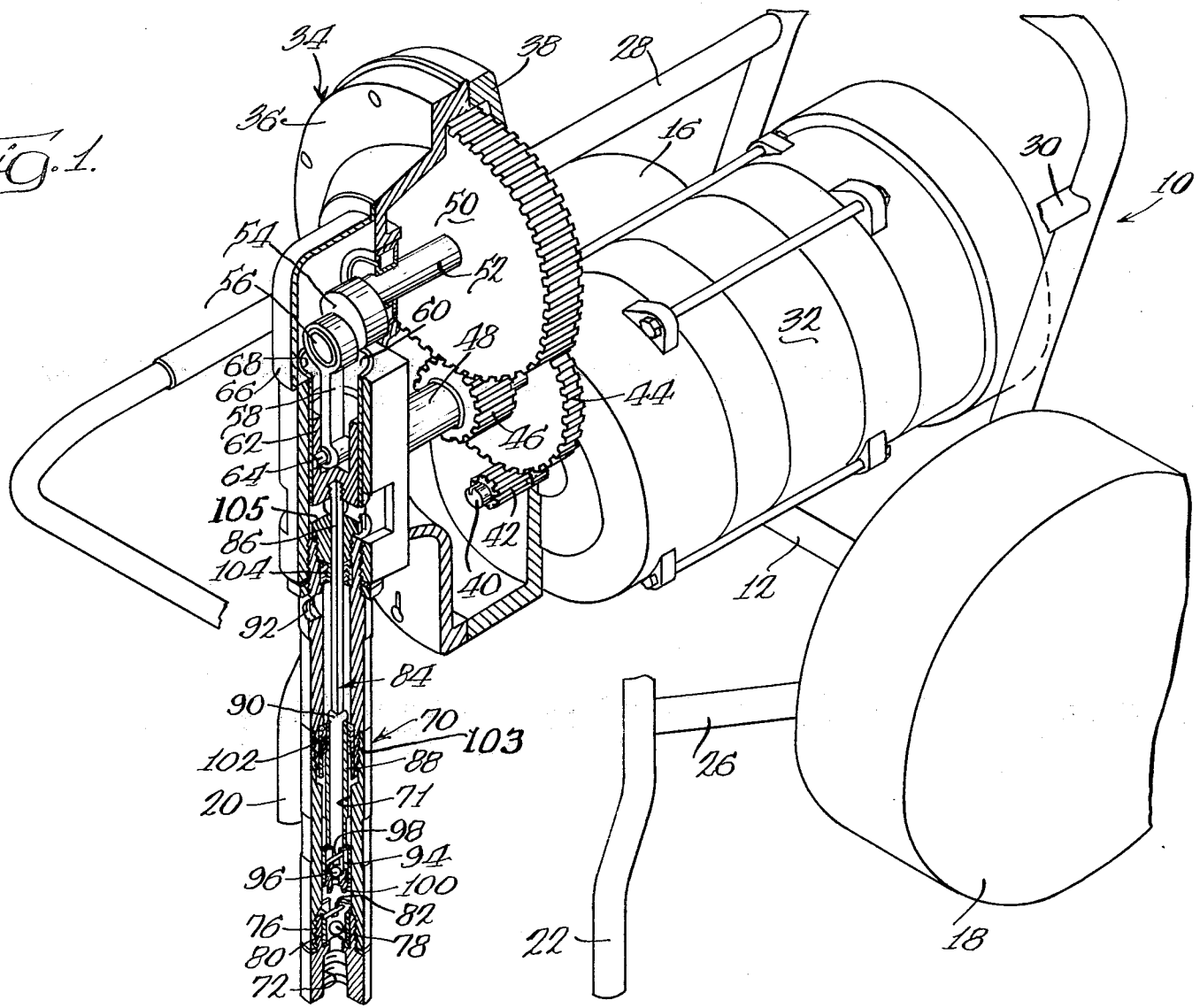
FIG. 1 is a perspective view of an airless spray pump device that incorporates features of the presently described invention, portions thereof having certain parts broken away to reveal their inner structure.
Figure 2:
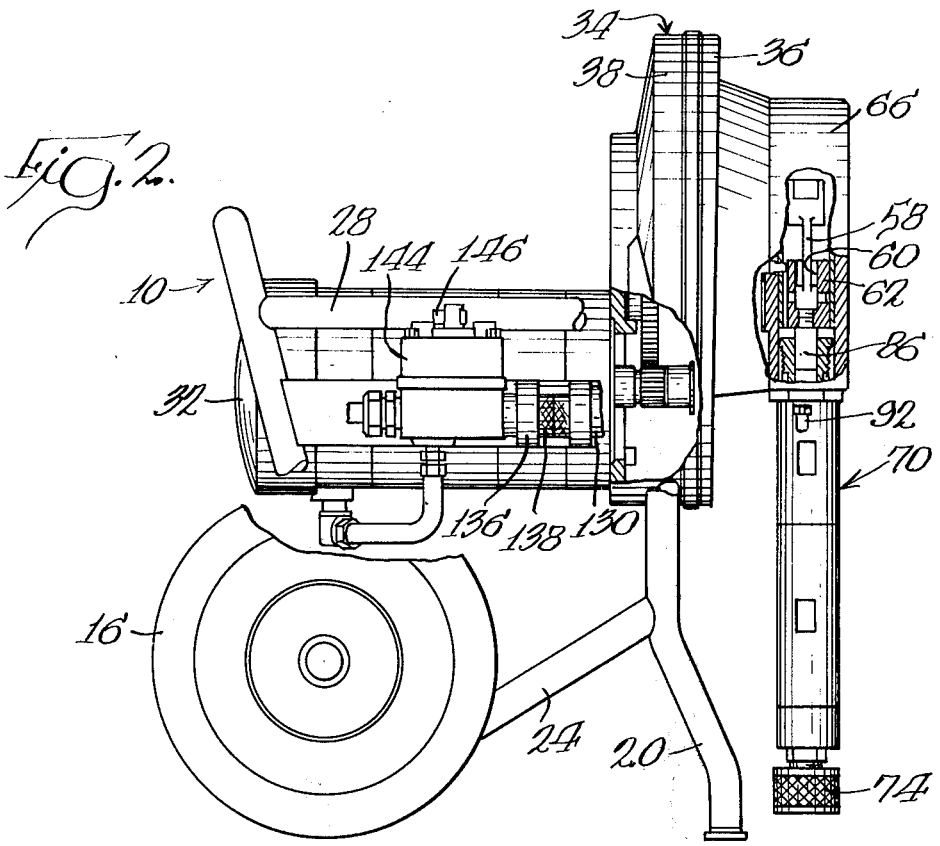
FIG. 2 is an elevational view of the device shown in FIG. 1, with certain parts broken away to reveal the inner structure.
Figure 3:
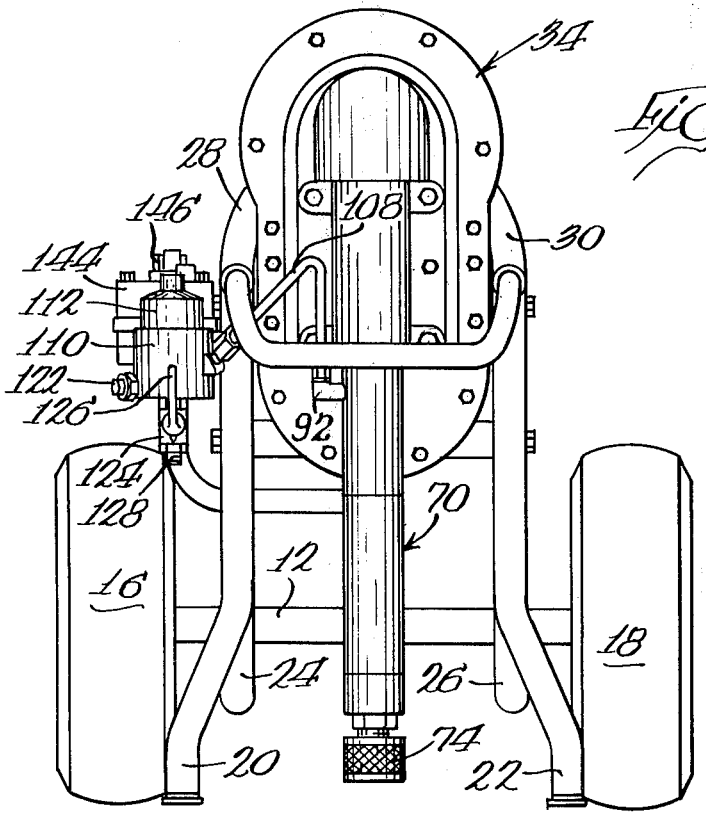
FIG. 3 is a front view of the device shown in FIGS. 1 and 2.

Referring to FIGS. 1, 2 and 3, the device is mounted upon a chassis 10 having a rear axle 12 with a pair of wheels 16 and 18 rotatably mounted thereon. The front of the chassis 10 is supported upon a pair of spaced vertical legs 20 and 22. A pair of lower supports 24 and 26 extend rearwardly from the respective legs 20 and 22 to be secured to the axle 12 and thence extend upwardly to merge in the form of an inverted U. A pair of upper supports 28 and 30 extend forwardly from an upper portion of the inverted U to the top of the legs 20 and 22 and thence forward of the legs. A U-shaped handle 31 is slidably mounted in the open forward ends of the upper supports 28 and 30. The handle 31 may be pulled out when required to facilitate pulling of the device from one location to another. The wheeled chassis described imparts complete portability to the pumping device.

Figure 4:
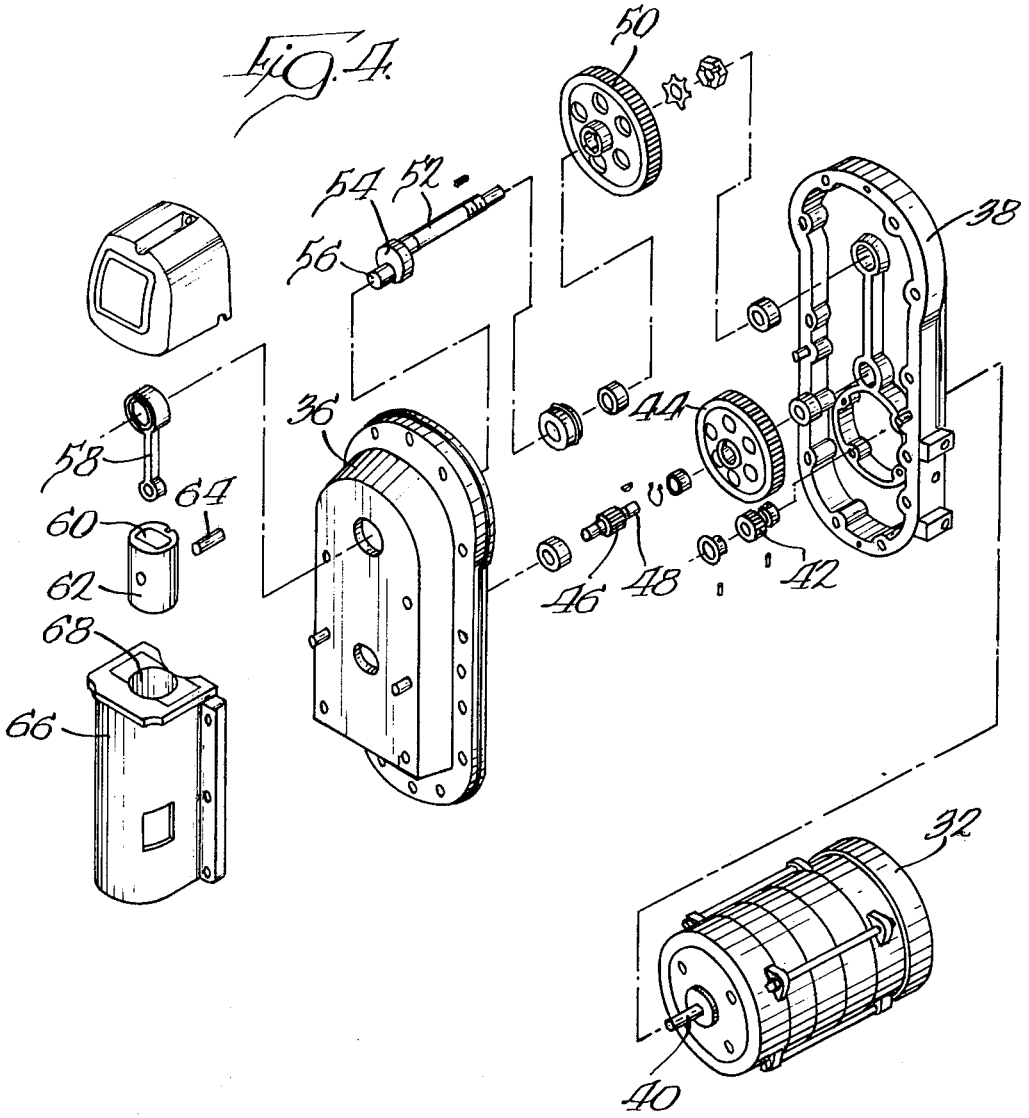
FIG. 4 is an exploded perspective view of the various parts of the drive assembly of the device shown in FIGS. 1, 2 and 3.

Secured within the chassis 10 is a heavy duty electric motor 32, preferably having a rating in the order of about ¾ hp, 110 v., 60 cycle (Hz) and 15 amp., which serves to drive the gear train and pump. As best shown in FIGS. 1 and 4, the housing of the motor 32 is secured at one end thereof to a gear housing 34 comprising respective forward and rear sections 36 and 38 which mate to form an enclosure for the gear train shown. The shaft 40 of the motor 32 extends through an aperture in the rear housing section 38, and a motor pinion 42 is secured on the shaft within the housing.

A first stage gear 44 and a coaxial second stage pinion 46 are secured on a common shaft 48 extending from both sides of said second stage gear and pinion, said shaft having its ends rotatably mounted in socket bearings within the respective housing sections 36 and 38. The shaft 48 is mounted adjacent and parallel to the motor shaft 40 with the proper degree of spacing therebetween to allow meshing of the motor pinion 42 with the first stage gear 44, the pinion being of smaller diameter than the first stage gear. An output gear 50 is keyed on a shaft 52 which is rotatably mounted at its rearward end in a socket bearing in the housing section 38 and adjacent its forward end in a bearing in the housing section 36. The shaft 52 is rotatably mounted adjacent and parallel to the second stage shaft 48 with the proper degree of spacing therebetween to allow meshing of the output gear 50 with the second stage pinion 46, thereby effecting a transmission of rotary motion at reduced speed from the motor shaft 40 to the shaft 52. The output gear 50 is of larger diameter than the second stage pinion 46, in turn of smaller diameter than the first stage gear, which is 44. The gear train is thus designed to reduce the speed of the motor, preferably in the order of from about 1725 rpm at the motor shaft to about 100 rpm at the output shaft.

The shaft 52 extends forwardly through the front wall of the housing 34 and carries at its forward end a crank 54 having a pin 56 secured or machined eccentrically thereon. A connecting rod 58 has an aperture at one end thereof rotatably mounted on the pin 56, and the other end thereof is similarly apertured and is received in a vertical slot or opening 60 in a cylindrical guide or crosshead 62 having a transverse opening for reception of a dowel pin 64 around which the other end of the rod 58 may be pivotally mounted, within said opening. A crosshead housing 66 is secured to the forward section 36 of the gear housing 34 and has a vertical cylindrical opening 68 in which the cylindrical guide 62 is slidably received for vertical reciprocation upon rotation of the motor shaft. Thus, the parts hereinbefore described comprise means for reducing the speed of the electric motor, as well as means for converting rotational motion of the motor shaft to reciprocating guided linear motion, by which an associated pump may be driven.

The pump shown generally at 70 is a single piston, double acting pump that is operated directly from the guide 62. The pump 70 is comprised of a three part housing defining an internal pump cylinder 71 coaxial with the opening 68 in the crosshead housing 66 and the guide 62. The pump housing comprises an upper cylindrical part screw threaded into the opening 68, a lower cylindrical part threadedly connected to the upper part and an inlet fitting threaded into the open bottom end of said lower part and defining a downwardly facing inlet opening 72 that may be internally threaded to receive an inlet strainer 74 (FIG. 2), in order to prevent foreign matter and solid conglomerates from entering the pump mechanism. It may be seen that the pump body 70 is positioned such that the inlet end is spaced a slight distance from the surface on which the chassis is resting, in order that the inlet may be conveniently dipped into a container of paint or other fluid material. Alternatively, a siphon hose may be connected between the inlet and a remote source of liquid material.

The pump 70 comprises a foot valve 76 of the ball type adjacent the inlet 72, said valve including a ball 78 sealingly engageable with an upwardly facing ring seat of the valve 76. A pin 82 mounted through aligned apertures in the valve body 76 and a ball cage 80 limits upward vertical movement of the ball 78 and holds the cage within the valve body.

Reciprocable within the pump housing 70 is a piston and piston rod assembly 84 comprised of a relatively elongate cylindrical piston 88 and a coaxial piston rod 86 of smaller diameter than the piston, the rod extending upwardly from the piston and being threadably connected at its upper end to the guide 62. The piston 88 is hollow or has a passage centrally therethrough, and a plurality of ports 90 are provided between said passage and the upper surface of the piston outwardly of the rod 86. A second ball cage 94 having an upwardly facing seat and a ball 96 therein is mounted by means of a pin 98 in a threaded sleeve 100, which in turn is in threaded engagement with the open bottom end of the piston 84. Lower stationary packing rings 102 are provided between the cylinder 71 and the piston 88. As shown, these rings are confined between the upper and lower cylindrical parts of the pump housing and thus are readily accessible for adjustment, repair or replacement. Upper stationary packing rings 104 are provided around the piston rod 86, and the pump outlet 92 extends radially through the pump housing just below the upper packing rings.

The structure thus defines two pumping chambers at opposite sides of the piston 84, namely, a first chamber between the foot or lower valve 76 and the lower end of the piston and a second chamber in the annular space surrounding the piston rod between the upper end of the piston and the upper seal assembly 104. The cylinder 71, piston 88 and piston rod 86 are so sized that the first or lower chamber has a volumetric capacity substantially twice as great as that of the upper chamber.

In operation, as the piston moves upwardly, a subatmospheric pressure condition is created in the lower chamber causing the valve 96 to close, the foot valve 78 to be lifted from its seat and a charge of paint or other material to be drawn into the lower chamber. On the down stroke of the piston, the foot valve 78 closes and the pressure imposed upon the material in the lower chamber forces the piston valve 96 open whereupon the material in the lower chamber is progressively displaced into the upper chamber through the valve and hollow passage in the piston. However, since the upper chamber has only half the capacity of the lower chamber, only one-half of the material in the lower chamber can be stored in the upper chamber and the remainder is discharged through the pump outlet 92. On the next upstroke of the piston 84, the lower chamber is again filled and at the same time the volume of the upper chamber is progressively decreased by movement of the piston into the same, whereupon the material that had been stored in the upper chamber is progressively discharged through the outlet 92. Thus, on each stroke of the pump, a predetermined volume of material (equal approximately to one-half the volume of the lower chamber) is discharged through the pump outlet.

The pump is operated at high speed through a short stroke, for example, 1½ inches, by the crank 54, whereby to provide a desired volume of material discharge, e.g., ½ gallon per minute, at high pressures of up to 2500 to 3000 psi. The only elements subject to any degree of wear are the seals 102 and 104, piston rod 84, and the ball valves 78 and 96, in that they are directly exposed to the material being pumped which in some cases may be highly abrasive. By virtue of the threaded assembly of the upper and lower cylinder parts to one another and the housing, and also the screw threaded assembly of the ball seat end cage members and the piston assembly, these parts can readily be disassembled for replacement of the seals and inspection and maintenance of the ball valves and their seats.

Another feature of the pump resides in the adjustability of the respective upper and lower seals or packings 102 and 104, which are non-dynamic. The inner diameter of the packing sets 102 and 104 are adjustable by means of respective nuts 103 and 105, which compressively abut the packing sets to the desired degree and form the required seal around the piston 88 and the rod 86. This feature eliminates the necessity of providing costly precision inner diameters on the cylinder and confines the wear primarily to the packing sets.

Referring now to FIGS. 2, 3, 5 and 6, a set of controls is provided at one side of the motor 32, the purpose of which controls are to electrically operate the motor, to control the degree of fluid pressure, and to prevent excess pressures from building up within the pump. As shown in FIG. 3, a pressure line 108 extends from the outlet 92 to a manifold 110 having a removable top 112 and containing a filter assembly, said assembly comprising an apertured upstanding filter support 114 with a corrugated filter element 116 disposed therearound, and a washer 118 and plug 120 to maintain the filter element in position and to filter all fluid that is pumped through the manifold. A threaded outlet fitting 122 is provided in the manifold for connection to a conventional hose and spray gun (not shown). Also, a conventional ball valve 124 having a manually operable handle 126 and an external opening 128 is provided at the bottom of the manifold to enable manual relief of pressure within the hydraulic system and draining of the filter at any time by an operator.

Means are associated with the manifold to adjust the pressure of fluid therein and to maintain the pressure at a constant level for each adjustment. For this purpose, a cylinder 130 is connected in fluid tight relationship with the manifold 110 and slidably contains a piston 132 mounted on a rod 134 that extends into one open end of a control housing 136 and is in threaded engagement with an axial threaded aperture in a cylindrical knob 138 within the housing. When assembled, the cylinder 130 is secured between the manifold 110 and the control housing 136, such that motion of the rod 134 caused by a change in fluid pressure on the piston 132 from the manifold is transmitted to the knob 138. A return spring 140 mounted between the piston 132 and the control housing 136 opposes the fluid pressure exerted against the piston. A plunger 142 having a head on one end is mounted in an aperture in the other side of the knob 138 coaxial with the piston rod 134, said plunger extending through an opposite open end of the control housing into adjacent switch housing 144.

A main switch 146 having a knob 148 for manual operation between on and off positions is mounted in the switch housing 144, and a normally closed micro switch 150 having a spring biased arm is connected in series with the main switch. The plunger 142 is engageable with the arm of the micro switch 150 to cause movement of the arm and opening of the switch. As shown, the switches are connected between an electrical cord 152 having a plug 154 and a line to the motor 32, whereby current flow to the motor may be interrupted, either by manual operation of the main switch 146, or by activation of the micro switch 150. The control housing 136 has a window 156 exposing the knob 138, and said knob may have a rough outer surface to facilitate manual rotation as well as a circumferential marking 158 thereon to indicate the position of the knob relative to the housing. In operation, a pressure increase within the manifold 110 will cause the piston 132 and its rod 134 to move toward the micro switch 150. Depending upon how far the knob 138 has been adjustably threaded on the piston rod 134, movement of the rod for a sufficient distance will cause movement of the knob 138 and hence movement of the plunger 142 against the arm of the micro switch 150, whereby said switch is activated into an open position, thereby opening the circuit between the motor and the current supply.

From the foregoing description, the advantages of the control system will become apparent. By adjusting the threaded knob 138 toward the micro switch 150, the distance between the end of the plunger 142 and the micro switch is decreased; hence, a relatively small pressure increase within the manifold 110 will cause the switch to be activated to shut down the motor. Either a pressure decrease in the manifold or adjustment of the knob away from the switch will allow the switch to close and the motor to operate until sufficient pressure is available to meet the demand of the changed conditions. The electric motor is operated only in response to a pressure deficiency sensed by the position of the piston 132 and continues to operate until the selected pressure is achieved. During intermittent operation of a spray gun connected to the outlet 122, substantially constant pressure is maintained at the gun orifice, regardless of whether the orifice is open or closed. When the motor is not operating and the orifice of the spray gun is closed, pressure is maintained in the system by the closure of the valves 96 and 78. Excessive pressure build up is accommodated simply by shutting down the motor, thereby eliminating the need for complex by-pass systems around the pump. Also, an economy is realized in that electric current is not used unless in response to a pressure requirement, whereas by-pass systems normally require continuous operation of the motor.

It has also been found that the foregoing arrangement allows for the selection of a wide range of operating pressures, such as from 0 to 2500 psi, by manually adjusting the knob 138 on the rod 134. In addition, the pump has a capacity of about a half a gallon per minute.

Heretofore, direct pressure responsive control of an electrical spray pump motor has not been considered feasible and therefore has not been successfully achieved. Since a direct pressure control system is instantaneously operative to shut down the motor at a specific pressure level, a long stroke pump would normally be shut down either above or below the desired level, thereby allowing an improper pressure to be stored. In spray painting, it is important to maintain a constant level of pressure at the spray tip in order to obtain a uniform spray pattern; hence, direct pressure control of an electric spray pump would normally be considered as impractical.

Despite the negative considerations mentioned above, the present invention allows for the direct pressure control of the motor of an electric spray pump. In accordance with the present invention, it has been discovered that an electric motor may be employed with a pressure responsive switch if the motor has a relatively high speed of operation and is connected to a drive train that directly operates the pump through a short stroke at high speed. Such a pump, having a stroke of about 1½ inches and operating at a speed of about 100 cpm, exhibits negligible pulsation, thereby enabling accurate operation of a pressure switch, while providing a constant pressure at the spray tip at all times. The present invention therefore uniquely provides a combination of an electrically driven pump with the pressure control switch in order to feed a spray gun at constant pressure.

Figure 7:
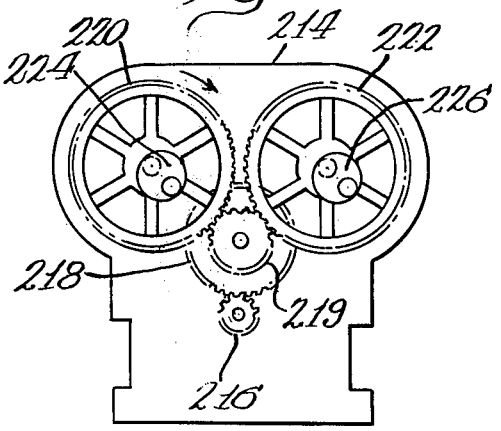
FIG. 7 is a vertical sectional view taken substantially along section line 7—7 of FIG. 6.
Figure 6:
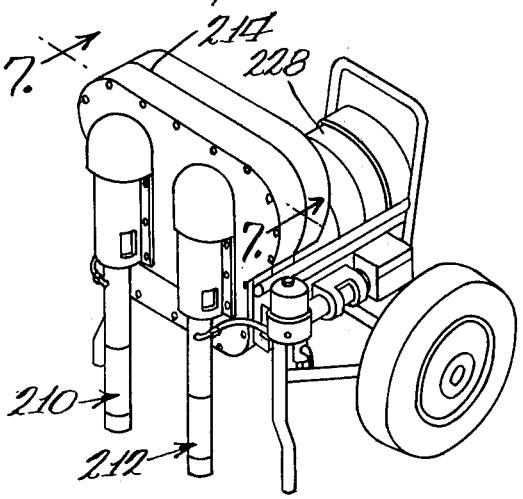
FIG. 6 is a perspective view of another embodiment of the invention wherein two pumps are operated simultaneously by a single motor.

Another embodiment of the invention is shown in FIGS. 6 and 7. This embodiment is identical in all respects to the embodiment previously described, with the exception that means are incorporated into the drive train to enable the simultaneous operation of two separate pumps from a single motor. The use of two separate pumps, such as the ones denoted as 210 and 212 in FIG. 6 is very advantageous in situations where a blending of two component materials may be required, such as with polyurethane foams or in situations where the blending of different color materials is required.

As shown in FIG. 6, the two separate pumps 210 and 212 depend from a common gear housing 214 that encloses the drive train shown in FIG. 7. In this embodiment, the motor pinion 216 driven by a single motor (not shown) meshes with a first stage gear 218 mounted on the same shaft as a second stage pinion 219. The motor pinion 216 may be mounted on a shaft separate from the motor shaft in order to facilitate demounting of the motor. The second stage pinion 219 is meshed with a pair of spaced output gears 220 and 222 having respective cranks 224 and 226 mounted thereon, to which the pumps are connected. An advantage of this gearing arrangement is that the forces exerted on the second stage pinion 219 are distributed to at least two non-adjacent teeth thereof, thereby avoiding localized stresses. In operation, the motor pinion 216 drives the first stage gear 218, causing the second stage pinion 219 to rotate the output gears 220 and 222 and their respective cranks 224 and 226 in the same direction, thereby operating the respective pumps 210 and 212 simultaneously.

Preferably, the output gears 220 and 222 are of the same diameter to assure operation of the respective pumps 210 and 212 at the same rates, although different gearing may be employed if unequal pumping rates are required. The throw lengths of the cranks 224 and 226 may be made unequal, if desired, to obtain different mixing ratios without altering the center distances between gears. Also, either or both of the fluid sections or pumps 210 and 212 may be exchanged for any of a variety of other pump sections having different volumetric capacities, such that any desired volumetric ratio may be achieved. It has been found that if the single motor has a rating of one and one-half horsepower, a pumping capacity of one gallon per minute at 2,000 psi may be easily achieved.

Figure 8:
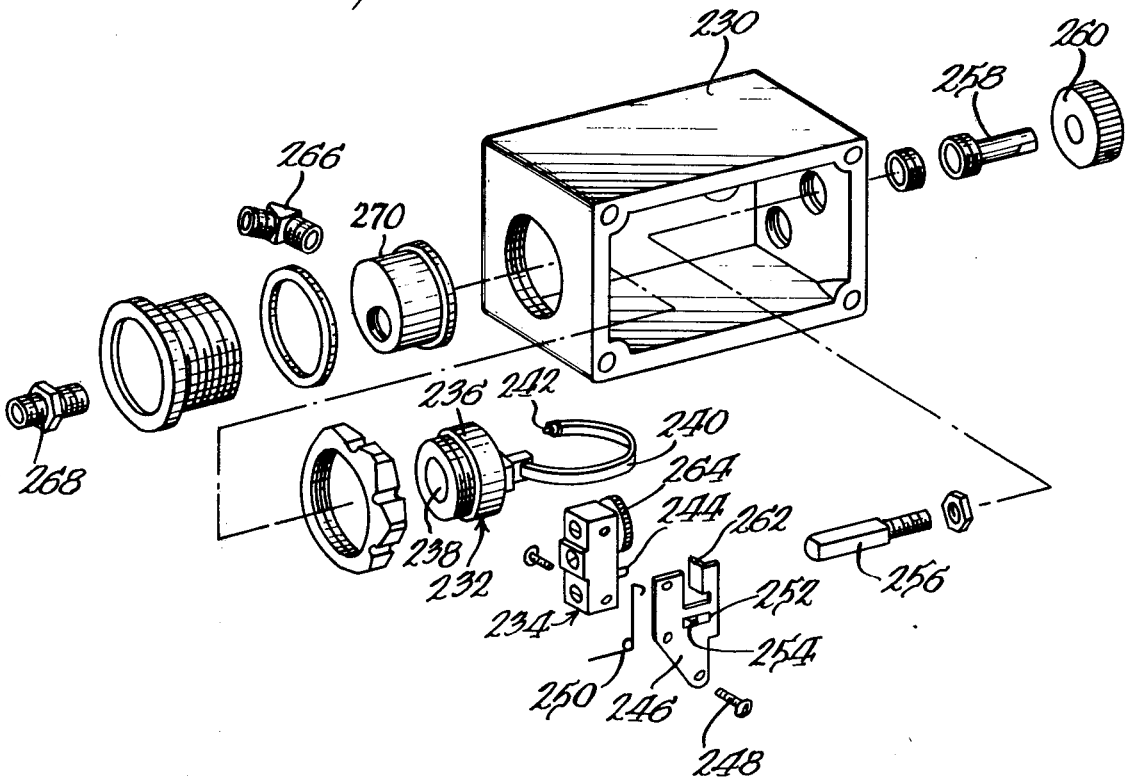
FIG. 8 is an exploded perspective view of an alternate pressure control assembly.

An alternate pressure control assembly is shown in FIG. 8, said assembly being particularly adapted for use with corrosive or highly active materials. Instead of a dead-end manifold, the presently described control comprises a flow through manifold communicating with a diaphragm protected, oil-filled bourdon tube that activates a normally open micro switch. The liquid material is allowed to continuously flow through the manifold surrounding the diaphragm, whereby the diaphragm surface is continuously purged. Thus, when pumping highly active materials, such as urethane foams, the flow through feature will prevent hardening of the material, which could cause the switch to become inoperative.

As shown in FIG. 8, the control comprises a housing 230 containing a bourdon tube and diaphragm assembly 232 operative to open and close a micro switch 234 mounted in the housing. The bourdon tube and diaphragm assembly 232 comprises a threaded collar 236 having a flexible diaphragm 238 mounted therein and connected to a curved semi-flexible tube 240 having a hooked and sealed free end 242. The collar 236 and the tube 240 may be filled with oil or the like, such that pressure exerted on the diaphragm 238 will cause the tube to straighten and become longer. The micro switch 234 is mounted adjacent the assembly 232 with its spring loaded contact 244 being compressively engageable by the free end 242 of the tube 240, whereby a deficiency in fluid pressure sensed by the diaphragm 238 will compress or close the normally open switch.

As shown, the switch 234 is mounted in a bracket 246 that is pivotally mounted at a free end thereof in the housing 230 by means of a screw 248 or the like. The pivotal mounting is such that the contact of the switch may be swung toward and away from the hooked end 242 of the tube 240. A spring 250 biased between the housing 230 and a hooked location in a window 252 in the bracket 246 yieldingly urges the bracket and micro switch 234 toward the bourdon tube end 242. The bracket 246 may also comprise an arm 254 pivotally mounted in the window 252 and extending across the contact 244, in order to increase the effective contact area of the switch contact to be engaged by the tube end 242.

Means are provided to adjust the position of the switch 234 relative to the tube end 242 so as to adjust the fluid pressure at which the switch will be opened to shut down the motor. A rod 256 is threadably engaged to a stem 258 extending through an end of the housing 230, said stem being manually rotatable by a knob 260. The free end of the rod 256 within the housing abuts a flange 262 of the spring biased switch bracket 246; hence, adjustment of the knob 260 causes pivotal movement of the switch 234 toward and away from the bourdon tube end 242. The switch 234 may also comprise an adjustable dead band 264 to increase or decrease the distance that the contact 244 travels before switching occurs. In this manner, a factory pre-adjustment of the maximum allowable pressure may be made, whereby excessive pressures will not be produced in the pump.

As shown, respective inlet and outlet fittings 266 and 268 are connected to a manifold 270 capped over the collar 236, with the outlet leading to a filter assembly similar to that previously described.

In the dual pump version shown in FIGS. 6 and 7, a pair of pressure control assemblies may be employed, one connected to each pump. In such cases, however, it is preferable to supply only one of the pressure control units with a manually adjustable knob, while the other is factory pre-adjusted. In this manner, the manually non-adjustable control may be set to become operative to shut down the motor in the event of failure of the adjustable control.

Figure 5:
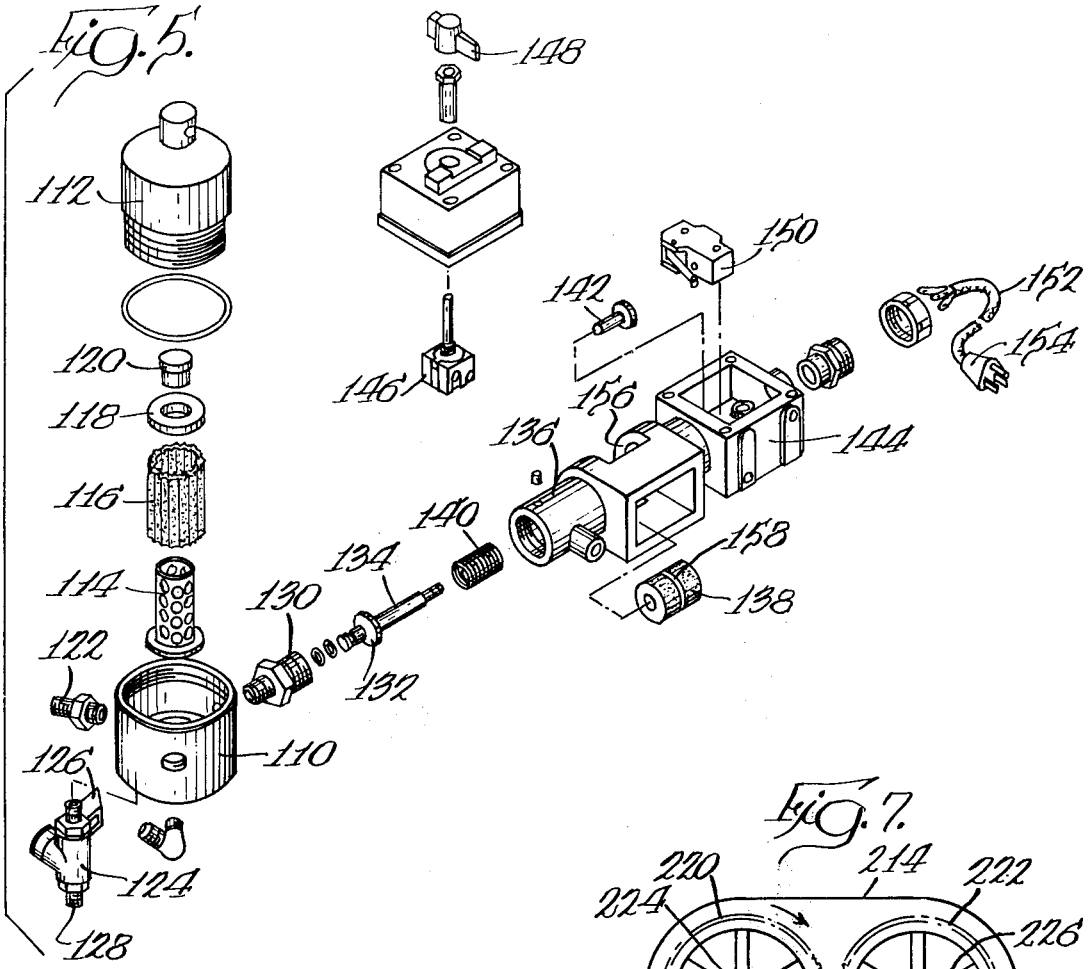
FIG. 5 is an exploded perspective view of the pressure control and filter assemblies used in connection with the device shown in FIGS. 1 through 4.

The operation of the pressure control of FIG. 8 is similar in principle to the operation of the control shown in FIG. 5 and will not be described in great detail. If the pressure is insufficient at the particular setting desired, the bourdon tube end 242 will remain in engagement with the arm 254 covering the contact 244 of the normally open switch 234 thereby maintaining the switch in a closed position. A sufficient increase in pressure will cause the tube end to move away from the switch, thereby allowing the switch to open and shut down the motor. The distance between the switch and the tube end may be varied by making manual adjustments to the knob 260, whereby the desired constant pressure may be selected.

Figure 9:
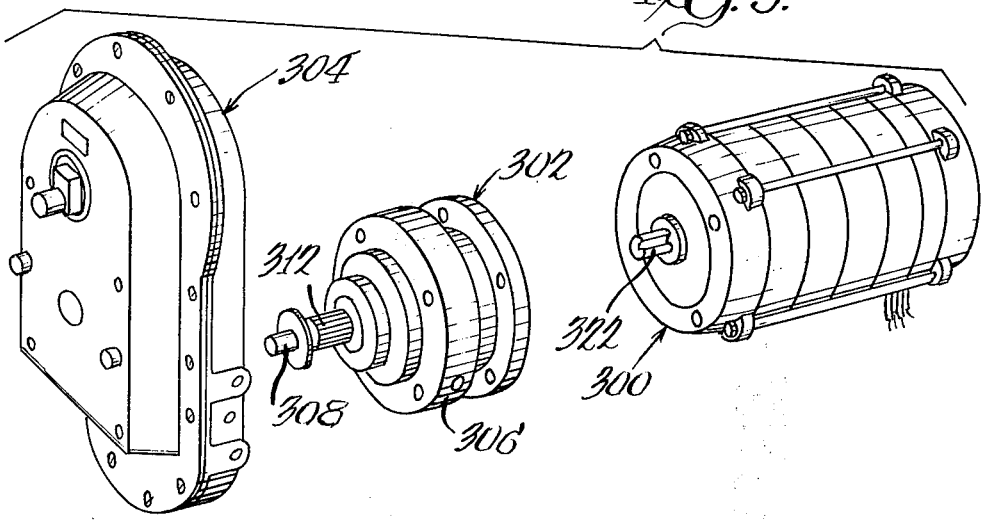
FIG. 9 is an exploded perspective view of another embodiment of the drive section which incorporates a clutch mechanism.
Figure 10:
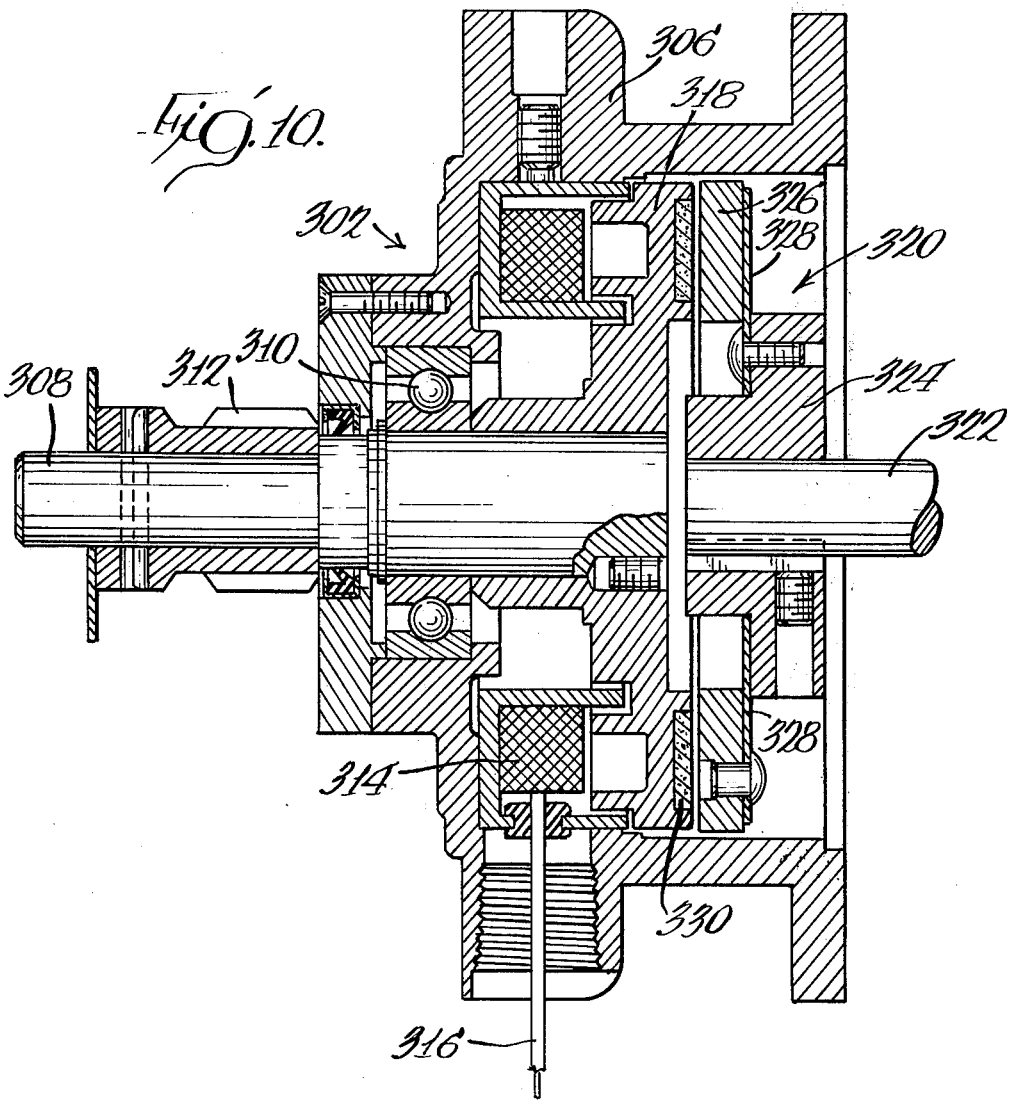
FIG. 10 is a vertical sectional view of the clutch mechanism shown in FIG. 9.

In another embodiment of the invention, shown in FIGS. 9 and 10, the motor 300 is allowed to run continuously during use of the spray equipment, and a clutch 302 is interposed between the motor and the gear housing 304. The clutch is engageable in response to pressure requirements as determined by the pressure sensing means in the control. This embodiment differs from the ones described previously, in that the pressure control switch is not connected to the motor for intermittent operation; rather, it is connected and operates the clutch mechanism 302. The clutch thus engages whenever the liquid pressure in the pump falls below a predetermined level and eliminates the need for frequent start up and shut down of the motor.

As shown in FIGS. 9 and 10, the clutch is preferably electrically operated and is electrically connected to one of the pressure control switches 150 or 234 of the previously described embodiments. These normally closed switches would serve to maintain the clutch in engagement until the pressure increased above a prescribed level, whereupon the clutch would be disengaged.

The clutch mechanism 302 comprises a housing 306 fixedly secured to the motor housing and having an output shaft 308 journalled on suitable bearings 310, said shaft terminating beyond said housing for reception in a suitable bearing in the gear housing 304. Mounted on the shaft 308 within the housing 304 is a pinion 312 adapted to mesh with the first stage gear in the gear housing. An annular field coil 314 is mounted in the housing 306 concentric with and spaced around the shaft 308, the coil being electrically connected by a line 316 to one of the aforesaid switches 150 or 234.

The other end of the shaft 308 terminates within the clutch housing 306 and is secured to a disc shaped rotor 318 that is axially spaced slightly inward from the coil 314 and is magnetized thereby when the coil is energized.

Also disposed within the housing 306 is an armature 320 that is mounted on the drive shaft 322 of the motor 300 for rotation therewith. The armature 320 is comprised of an inner annular hub 234 secured to the motor shaft 322 and an outer annular clutch ring 326 universally mounted on the hub 324 by means of a leaf springs 328. The springs 328 interconnect the hub 324 and the ring 326 for conjoint rotation with the motor shaft, normally bias the ring axially away from the clutch rotor 318, accommodate movement of the ring 326 axially into engagement with the rotor 318, accommodate universal movement of the ring to insure abutting engagement of the ring with the rotor over their full faces, and perform a shock-absorbing function upon engagement of the rotating ring with the stationary rotor. Friction material 330 may also be provided on the mating faces of one or both of the ring and rotor to aid in shock absorption. Thus, upon energization of the coil 314, an electromagnetic field or loop is established between the coil mounting cup 314a, the adjacent portions of the rotor 318 and the ring 326 of the armature 320, whereby the ring is drawn into and held in engagement with the rotor 318 to transfer torque between the motor 300 and the gears in the gear housing 304.

In operation, the motor 300 is activated, and current flows through the normally closed switch 150 or 234 to energize the stationary coil 314. The coil 314 sets up a magnetic field which draws the ring 326 of the armature 320 into engagement with the rotor 318. When the set liquid pressure is attained, the switch 150 or 234 opens to disengage the clutch 302, allowing the motor to run freely and causing the pump to stop and maintain the preselected pressure in the system.

From the foregoing, it will be obvious to those skilled in the art that many other modifications may be made to the illustrated embodiments of the invention. For example, a variety of power train arrangements may be employed between the motor and the pump that would serve a purpose equivalent to the gear train employed herein. Obviously, if it were advantageous to mount the motor vertically, means could be employed to translate the rotary motion of the motor from one axis to the specific rotational axis associated with the crank of the pump. Accordingly, to the extent that such modifications are not expressly excluded from the appended claims, they are fully intended to be covered therein.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description.

We claim:

1. In a liquid pumping system for an airless spray gun wherein liquid is to be supplied to the gun under substantially uniform pressure in the range of up to 3000 pounds per square inch and the gun is intermittently turned off and on thereby tending to cause fluctuations in the liquid pressure at the gun, a pump and operating mechanism therefor comprising, in combination, a double-acting positive displacement pump having a cylinder with an inlet at its lower end and an outlet adjacent its upper end, a piston reciprocable in said cylinder between said inlet and said outlet, a piston rod connected to and reciprocable with said piston extending from the upper end of said cylinder, a passage through said piston, and check valves in said inlet and said passage, said piston and piston rod being proportioned to displace half the volume of said cylinder whereby said cylinder is filled with liquid on alternate strokes of said piston and one half of a cylinder full of liquid is discharged from said outlet on each stroke of said piston; a crosshead housing at the upper end of said pump cylinder having a cylinder therein aligned with said pump cylinder, a crosshead reciprocably and guidably mounted in said crosshead cylinder and connected to the upper end of said piston rod, and a connecting rod pivotally connected at its lower end to said crosshead; a high speed electric motor having a drive shaft; a speed-reducing power-multiplying gear train connected to said drive shaft and including an electric clutch; said gear train having an output shaft including an eccentric pivotally connected to the upper end of said connecting rod for positively interconnecting said motor and said piston for reciprocating said piston in said cylinder; said crosshead isolating said pump and said piston and piston rod from the gyratory movement of said eccentric and said connecting rod; an outlet manifold having an inlet connected to said pump outlet and an outlet, an adjustable pressure responsive switch on said manifold responsive to the pressure of the liquid flowing through said manifold, an electric circuit connected to said clutch including said switch and responsive thereto to cause said pump to start and stop operating as a function of pressure, said switch being operative to activate and deactivate said clutch for causing said pump to stop operating when the liquid pressure exceeds a preselected pressure and for causing said pump to start operating when the liquid pressure falls below said preselected pressure, and means for adjusting said switch to respond to any selected pressure over a range of pressures.

2. In a liquid pumping system for plural component airless spray gun means wherein at least two liquids are to be supplied to the gun means under substantially uniform pressures in the range of up to 3000 pounds per square inch and the gun means is intermittently turned off and on thereby tending to cause fluctuations in the liquid pressures at the gun, a pump and operating mechanism therefor comprising, in combination, a pair of double-acting positive displacement pumps each having a cylinder with an inlet at its lower end and an outlet adjacent its upper end, a piston reciprocable in said cylinder between said inlet and said outlet, a piston rod connected to and reciprocable with said piston extending from the upper end of said cylinder, a passage through said piston, and check valves in said inlet and said passage, said piston and piston rod being proportioned to displace half the volume of said cylinder whereby said cylinder is filled with liquid on alternate strokes of said piston and one half of a cylinder full of liquid is discharged from said outlet on each stroke of said piston; a crosshead housing at the upper end of each of said pump cylinders having a cylinder therein aligned with the respective pump cylinder, a crosshead reciprocably and guidably mounted in each said crosshead cylinder and connected to the upper end of the respective piston rod, a connecting rod pivotally connected at its lower end to each of said crossheads; a high-speed electric motor having a drive shaft; a speed-reducing power-multiplying gear train connected to said drive shaft and including an electric clutch; said gear train having a pair of output shafts each including an eccentric pivotally connected to the upper end of a respective one of said connecting rods for positively interconnecting said motor and said pistons for reciprocating said pistons in said cylinders; said crossheads isolating said pumps and said pistons and piston rods from the gyratory movement of said eccentrics and said connecting rods; an outlet manifold one each said pump having an inlet connected to the pump outlet and an outlet, an adjustable pressure responsive switch on one of said manifolds responsive to the pressure of the liquid flowing through said manifold, an electric circuit connected to said clutch including said switch and responsive thereto to cause said pumps to start and stop operating as a function of pressure, said switch being operative to activate and deactivate said clutch for causing said pumps to stop operating when the liquid pressure exceeds a preselected pressure and for causing said pumps to start operating when the liquid pressure falls below said preselected pressure, and means for adjusting said switch to respond to any selected pressure over a range of pressures.

3. A liquid pump system as set forth in claim 2 wherein at least one of said pumps is exchangeable with other pumps of different volumetric capacities to vary the ratio between the liquids pumped by the two pumps.

4. A liquid pump and operating mechanism therefor comprising, in combination, a double-acting positive displacement pump having a cylinder with an inlet at its lower end and an outlet adjacent its upper end, a piston reciprocable in said cylinder between said inlet and said outlet, a piston rod connected to and reciprocable with said piston extending from the upper end of said cylinder, a passage through said piston, and check valves in said inlet and said passage, said piston and piston rod being proportioned to displace half the volume of said cylinder whereby said cylinder is filled with liquid on alternate strokes of said piston and one half of a cylinder full of liquid is discharged from said outlet on each stroke of said piston; a crosshead housing at the upper end of said pump cylinder having a cylinder therein aligned with said pump cylinder, a crosshead reciprocably and guidably mounted in said crosshead cylinder and connected to the upper end of said piston rod, and a connecting rod pivotally connected at its lower end to said crosshead; a high-speed electric motor having a drive shaft; an electrically operated clutch coupled to said drive shaft; a speed-reducing power-multiplying gear train connected to said drive shaft through said clutch and having an output shaft including an eccentric pivotally connected to the upper end of said connecting rod for positively interconnecting said motor and said piston for reciprocating said piston in said cylinder; said crosshead isolating said pump and said piston and piston rod from gyratory movement of said eccentric and said connecting rod; an outlet manifold having an inlet connected to said pump outlet and an outlet, an adjustable pressure responsive switch on said manifold responsive to the pressure of the liquid flowing through said manifold, an electric circuit connected to said clutch including said switch and responsive to said switch for disengaging said clutch when the liquid pressure exceeds a preselected pressure and for engaging said clutch when the liquid pressure falls below said preselected pressure, and means for adjusting said switch to respond to a preselected one of a range of pressures.

5. A pump as set forth in claim 4 including a frame, said motor being mounted horizontally on said frame, a gear train housing mounted on the housing of said motor and enclosing said gear train, said crosshead housing being mounted on said gear train housing and enclosing said eccentric and said connecting rod, the cylinder of said pump being mounted vertically on and extending downward from said crosshead housing, said housings providing a compact pump assembly.

6. The pump according to claim 4 wherein said clutch comprises a housing, a magnetic coil in said housing energized by said switch means, a rotor in said housing connected to said gear train, an armature connected to the drive shaft of said motor and rotatable therewith, said armature being axially movable on said drive shaft and attracted to said rotor upon energization of said coil.

7. In a liquid pumping system for an airless spray gun wherein liquid is to be supplied to the gun under substantially uniform pressure in the range of up to 3000 pounds per square inch and the gun is intermittently turned off and on thereby tending to cause fluctuations in the liquid pressure at the gun, a pump and operating mechanism therefor comprising, in combination, a double-acting positive displacement pump having a cylinder with an inlet at its lower end and an outlet adjacent its upper end, a piston reciprocable in said cylinder between said inlet and said outlet, a piston rod connected to and reciprocable with said piston extending from the upper end of said cylinder, a passage through said piston, and check valves in said inlet and said passage, said piston and piston rod being proportioned to displace half the volume of said cylinder whereby said cylinder is filled with liquid on alternate strokes of said piston and one half of a cylinder full of liquid is discharged from said outlet on each stroke of said piston; a crosshead housing at the upper end of said pump cylinder having a cylinder therein aligned with said pump cylinder, a crosshead reciprocably and guidably mounted in said crosshead cylinder and connected to the upper end of said piston rod, and a connecting rod pivotally connected at its lower end to said crosshead; a high-speed electric motor having a drive shaft; a speed-reducing power-multiplying gear train connected to said drive shaft and having an output shaft including an eccentric pivotally connected to the upper end of said connecting rod for positively interconnecting said motor and said piston for reciprocating said piston in said cylinder; said crosshead isolating said pump and said piston and piston rod from the gyratory movement of said eccentric and said connecting rod; an outlet manifold having an inlet connected to said pump outlet and an outlet for flow therethrough of the pumped liquid; an adjustable pressure responsive switch on said manifold responsive to the pressure of the liquid flowing through said manifold, said switch including a housing having an inlet and an outlet connected in series with the pump outlet for continuous flow therethrough of the pumped liquid, and a flexible diaphragm in said housing for coupling the switch to the hydraulic pressure of the liquid in said housing but physically isolating the switch from contact with the pumped liquid; an electric circuit including said switch and responsive thereto to cause said pump to start and stop operating as a function of pressure for causing said pump to stop operating when the liquid pressure exceeds a preselected pressure and for causing said pump to start operating when the liquid pressure falls below said preselected pressure, and means for adjusting said switch to respond to any selected pressure over a range of pressures.

* * * * *